US007478965B2

(12) United States Patent
Shapiro

(10) Patent No.: US 7,478,965 B2
(45) Date of Patent: Jan. 20, 2009

(54) NOTEBOOK/PORTFOLIO WITH WRITING PAD

(75) Inventor: David Shapiro, Chicago, IL (US)

(73) Assignee: It's Academic of Illinois, Inc., Northbrook, IL (US)

( * ) Notice: Subject to any disclaimer, the term of this patent is extended or adjusted under 35 U.S.C. 154(b) by 625 days.

(21) Appl. No.: 11/285,570

(22) Filed: Nov. 22, 2005

(65) Prior Publication Data

US 2007/0114782 A1 May 24, 2007

(51) Int. Cl.
*B42F 13/00* (2006.01)

(52) U.S. Cl. ..... 402/73; 402/4; 281/29; 281/45; 281/31

(58) Field of Classification Search ..... 206/214, 206/232; 190/102; 40/726; 402/4, 70, 73, 402/80 R, 502; 281/15.1, 29, 39, 45, 51, 281/33, 31

See application file for complete search history.

(56) References Cited

U.S. PATENT DOCUMENTS 501,508 A * 7/1893 Hays ..... 281/16
676,857 A * 6/1901 White ..... 281/15.1
3,142,495 A * 7/1964 Lu ..... 281/29
4,365,708 A * 12/1982 Tyus ..... 206/309
4,605,245 A * 8/1986 Weaver ..... 281/34
5,115,893 A * 5/1992 Terkildsen ..... 190/11
5,232,301 A * 8/1993 Bianco ..... 402/73
5,240,340 A * 8/1993 Lynch et al. ..... 402/79
5,667,064 A * 9/1997 Bauman ..... 206/214
5,678,943 A * 10/1997 Parsons ..... 402/79
7,165,788 B2 * 1/2007 Smith et al. ..... 281/45
2005/0046173 A1 * 3/2005 Hall et al. ..... 281/31

* cited by examiner

*Primary Examiner*—Dana Ross
*Assistant Examiner*—Jamila Williams
(74) *Attorney, Agent, or Firm*—Wood, Phillips, Katz, Clark & Mortimer

(57) ABSTRACT

A portable carrier for papers, including two generally rectangular panels connected along one side and defining an interior there between. A closure is secured along three edges to the exterior of one of the panels to define a pouch between the one panel and the closure, with the pouch having an opening along a fourth edge. Two straps extend substantially parallel to two of the secured edges of the closure, with the straps each being secured in the pouch with one end at the pouch opening and the other end in the pouch adjacent the secured closure edge opposite the pouch opening. A pad is slidably connected along one side to the straps and has a storage position substantially within the pouch and a writing position outside the pouch on the closure. A mount is adapted to secure writing paper to the pad.

18 Claims, 3 Drawing Sheets

NOTEBOOK/PORTFOLIO WITH WRITING PAD

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention is directed toward portable paper organizers and carriers, and particularly toward notebooks, portfolios and the like.

BACKGROUND OF THE INVENTION AND TECHNICAL PROBLEMS POSED BY THE PRIOR ART

Notebooks and portfolios have long been widely used by students and professionals alike to organize their papers, particularly papers of written materials. The notebooks and portfolios are also portable to enable their users to readily carry the organized papers with them.

Of course, such notebooks and portfolios are commonly carried by persons who not only may require the old notes and papers organized therein, but also commonly expect to receive and/or make new papers relating to the subject matters included among the organized papers. As such, blank papers are commonly carried in the notebooks and portfolios, with the user removing blank papers as needed from the notebook to take notes on and then return to the notebook when done. While this is advantageous, it may sometimes be difficult to locate a blank sheet of paper to use for taking notes. Also, particularly for notebooks, it may be clumsy to open the notebook and remove a sheet of paper for note taking (or to take notes on a sheet while it remains in the notebook) if, as can frequently be the case, clear desk space is not readily available to allow the user to lay down the notebook while it is opened to access paper therein. Even after getting the paper, taking notes on the paper can be clumsy without such desk space. For example, taking notes while walking around can be extremely clumsy.

The present invention is directed toward overcoming one or more of the problems set forth above.

SUMMARY OF THE INVENTION

According to one aspect of the present invention, a portable carrier for papers is provided, including two generally rectangular panels connected along one side and defining an interior therebetween. A closure is secured along three edges to the exterior of one of the panels to define a pouch between the one panel and the closure, with the pouch having an opening along a fourth edge. Two straps extend substantially parallel to two of the secured edges of the closure, with the straps each being secured in the pouch with one end at the pouch opening and the other end in the pouch adjacent the secured closure edge opposite the pouch opening. A pad is slidably connected along one side to the straps and has a storage position substantially within the pouch and a writing position outside the pouch on the closure. A mount is adapted to secure writing paper to the pad, where the pad is moved from the storage position to the writing position by sliding the pad along the straps to an intermediate position outside the pouch and then pivoting the pad about the connected side relative to the straps.

In one form of this aspect of the present invention, the pad is substantially rectangular, and the connected one side of the pad includes flexible loops around the straps extending from the pad.

In another form of this aspect of the present invention, one face of the pad is adjacent the one panel when the pad is in the storage position, and the mount is on the one face of the pad. In a further form, the mount includes a flap on a corner of the pad one face along the pad one side adapted to cover a corner of secured writing paper.

In still another form of this aspect of the present invention, the pad is at least 11 inches along the fourth edge and the pouch opening is greater than the length of the pad along the fourth edge.

In yet another form of this aspect of the present invention, the mount comprises a tablet pouch adapted to receive the back of a paper tablet.

In still another form of this aspect of the present invention, a zipper along the closure fourth edge selectively closes the pouch opening when the pad is in the storage position.

In another form of this aspect of the present invention, the connected one side of the two panels is hinged. In a further form, the container is a portfolio having a zipper closure between the other three sides of the rectangular panels, and in another form, the container is a ring notebook.

In yet another form of this aspect of the present invention, a holder for a writing instrument is on the pad.

In another aspect of the present invention, a personal carrier for papers includes two generally rectangular panels hinged together along one side and defining an interior therebetween. A closure is secured along three edges to the exterior of one of the panels to define a pouch between the one panel and the closure, the pouch having an opening along a fourth edge. Two straps extend substantially parallel to two of the secured edges of the closure, the straps each being secured in the pouch with one end at the pouch opening and the other end in the pouch adjacent the secured closure edge opposite the pouch opening. A pad has flexible loops on one side slidably connected to the straps, and a tablet pouch on the pad is adapted to receive the back of a paper tablet to secure the paper tablet thereon. The pad is moved from a storage position substantially within the pouch to a writing position outside the pouch and on the closure by sliding the pad along the straps to an intermediate position outside the pouch and then pivoting the pad about the connected side relative to the straps. One face of the pad is adjacent the one panel when the pad is in the storage position, and the tablet pouch is on the one face of the pad.

In one form of this aspect of the present invention, a flap is on a corner of the pad one face along the pad one side adapted to cover a corner of secured writing paper.

In still another form of this aspect of the present invention, the pad is at least 11 inches along the fourth edge and the pouch opening is greater than the length of the pad along the fourth edge.

In still another form of this aspect of the present invention, a zipper along the closure fourth edge selectively closes the pouch opening when the pad is in the storage position.

In one form of this aspect of the present invention, the container is a portfolio having a zipper closure between the other three sides of the rectangular panels, and in another form, the container is a ring notebook.

In yet another form of this aspect of the present invention, a holder for a writing instrument is on the pad.

DETAILED DESCRIPTION OF THE INVENTION

A notebook 10 according to one embodiment of the present invention is illustrated in FIGS. 1-5.

The notebook 10 includes two rectangular panels 12, 14 connected along one side by a hinge side 18 to define a paper storage space between the panels 12, 14. A three ring binder 20 may be suitably secured to the hinge side 18 such as is well known in the art to facilitate organizing and retaining paper in the storage space.

Figure 2:
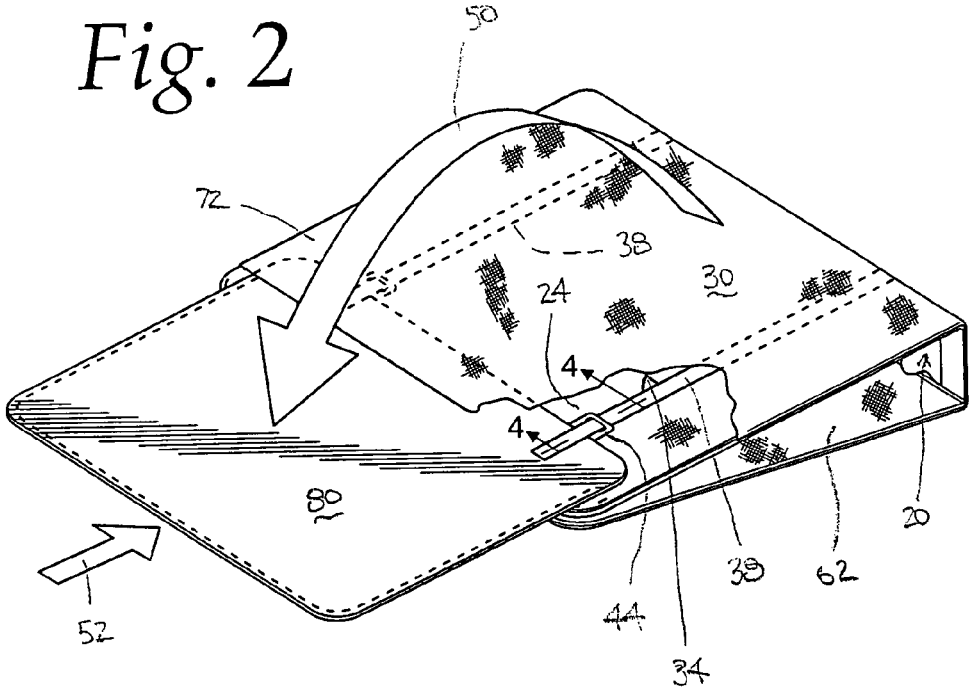
FIG. 2 is a perspective view of the FIG. 1 notebook, with the tablet being moved to a storage position.

Secured along three sides on the outer face 24 of one of the rectangular panels 12 is a closure 30 which defines a pouch 34 (see particularly FIG. 4) between it and the panel 12. As illustrated in FIG. 2 particularly, two straps 38 are suitably secured at opposite ends in the pouch 34, with the straps 38 being oriented so as to extend substantially from the bottom of the pouch 34 to the open side of the pouch 34, generally parallel to the lateral sides of the pouch 34.

Figure 1:
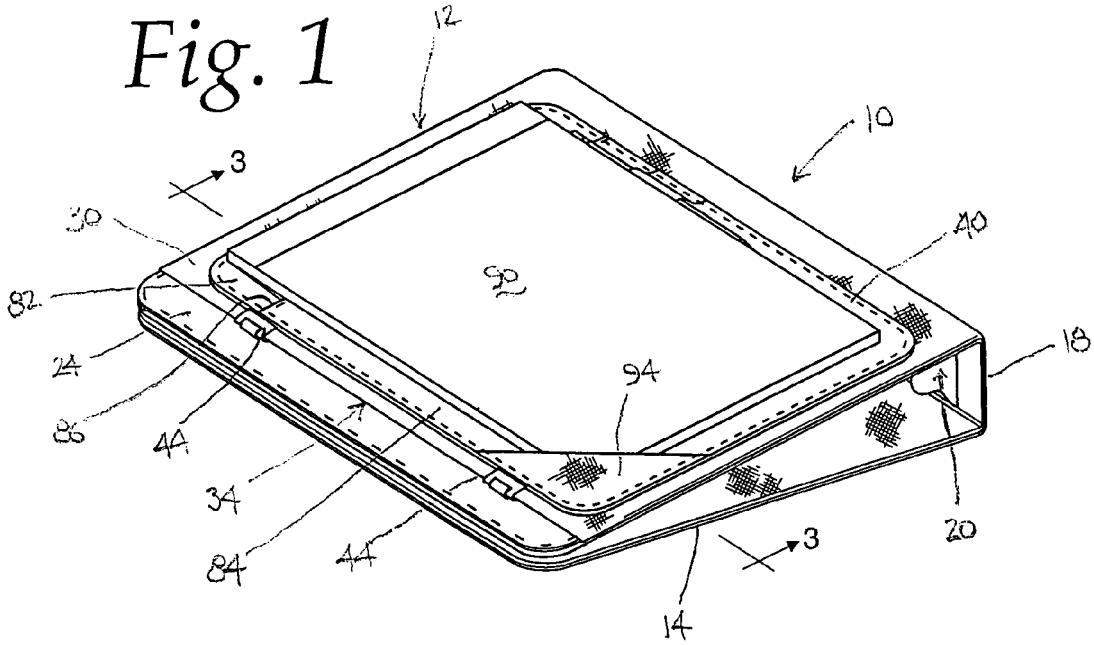
FIG. 1 is a perspective view of a notebook incorporating the present invention, with a paper tablet supported in a writing position.

A pad 40 has two flexible loops 44 extending from one side, with the flexible loops 44 each being around an associated strap 38 whereby the loops 44 may slide along the straps 38 between the secured strap ends. Thus, it should be appreciated that the pad 40 may be oriented in a writing position as shown in FIG. 1, with the pad 40 on top of the closure 30 outside the pouch 34 (and the flexible loops 44 adjacent the strap ends at the opening of the pouch 34, and bent) for use as further described below. From the writing position, the pad 40 may be moved to its storage position inside the pouch 34 by first pivoting the pad 40 about the loops 44 (see arrow 50 in FIG. 2) to a position aligned with the pouch 34, and then slid inside the pouch 34 (see arrow 52 in FIG. 2) with the loops 44 sliding along the straps 38 as the pad 40 slides in.

Figure 3:
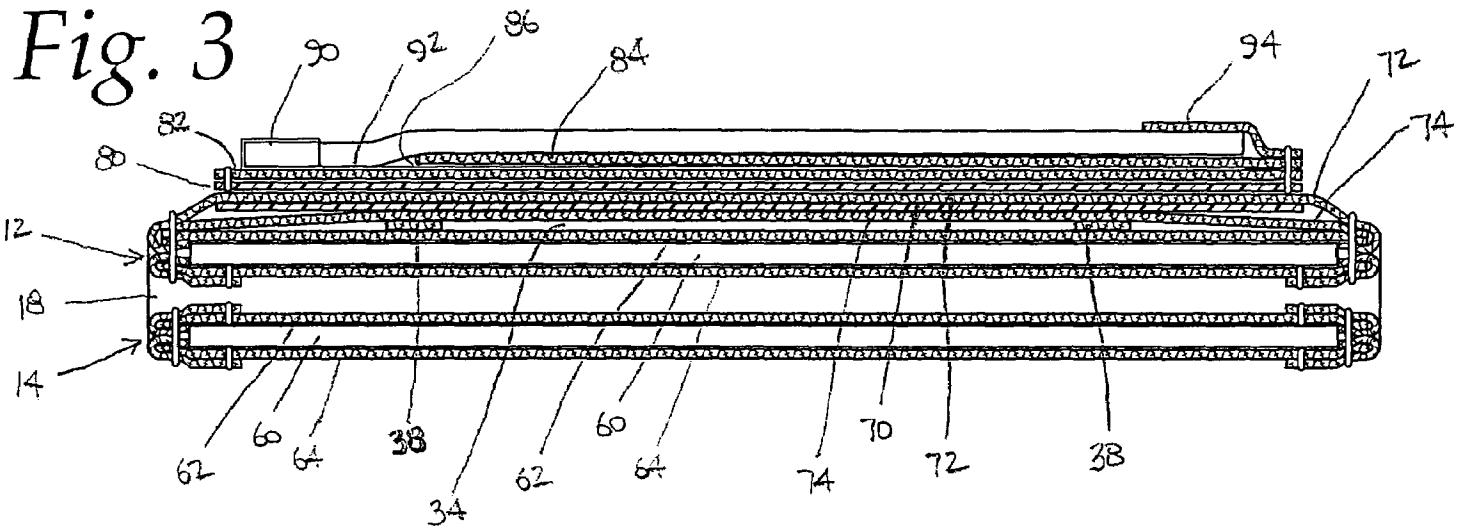
FIG. 3 is a cross-sectional view taken along line 3-3 of FIG. 1.
Figure 4:
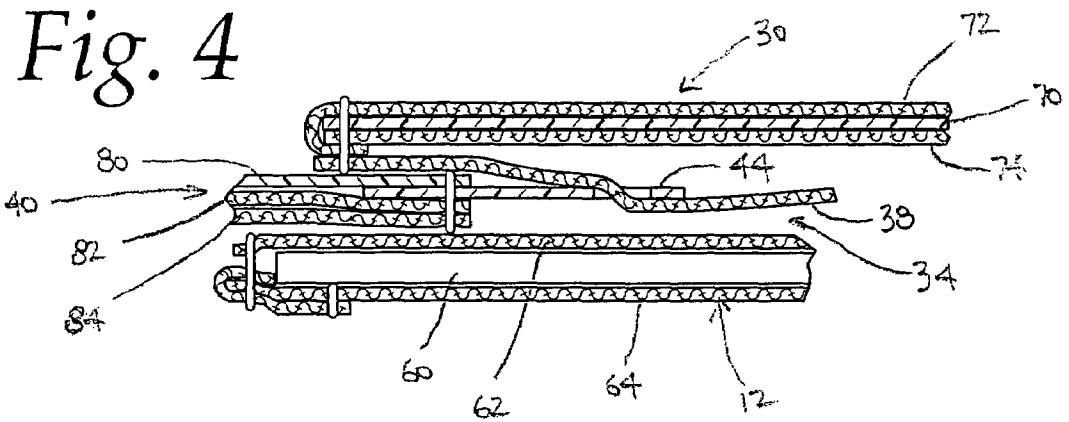
FIG. 4 is a cross-sectional view taken along line 4-4 of FIG. 2.

The notebook 10 is illustrated in cross-section in FIG. 3, from which it can be seen that the illustrated embodiment is a high quality notebook 10 with cloth covering. Specifically, the panels 12, 14 each contain a stiff inner core 60 with upper and lower cloth layers 62, 64 which are suitably secured by stitching or the like around the sides of the cores 60.

The closure 30 also as a stiff inner core 70 (thinner than the panel cores 60) covered by upper and lower cloth layers 72, 74 which are suitably secured by stitching or the like around the sides of the core 70, and are similarly secured to the panel 12 along three sides to define the pouch 34 therebetween.

The pad 40 includes a stiff backing 80 with a cloth layer 82 stitched on one side, and a second cloth layer 84 stitched over it to define a tablet pouch 86 between the cloth layers 82, 84, where the second cloth layer is shorter in one dimension and not secured to the pad 40 along the shortened side so as to define an opening into the tablet pouch 86. It should therefore be appreciated that, as illustrated in the figures, a conventional paper tablet 90 may be readily mounted to the pad 40 by sliding its stiff cardboard backing 92 into the tablet pouch 86 (see FIG. 3).

Further, a corner flap 94 may also be secured on the pad 40 allowing a corner of the paper tablet 90 to be secured under the flap 94. This flap 94 will not only hold the paper down when in the writing position, but will also protect that corner of the tablet 90 (which consists of a stack of loose sheets of paper) so that the paper is not damaged when the pad 40 is pushed into the pouch 34. Of course, it should also be appreciated that, in the storage position inside the pouch 34, the paper tablet 90 will be protected, and therefore the notebook 10 can be normally carried, stored, etc. without worry that the paper tablet 90 will be damaged when doing so.

Figure 5:
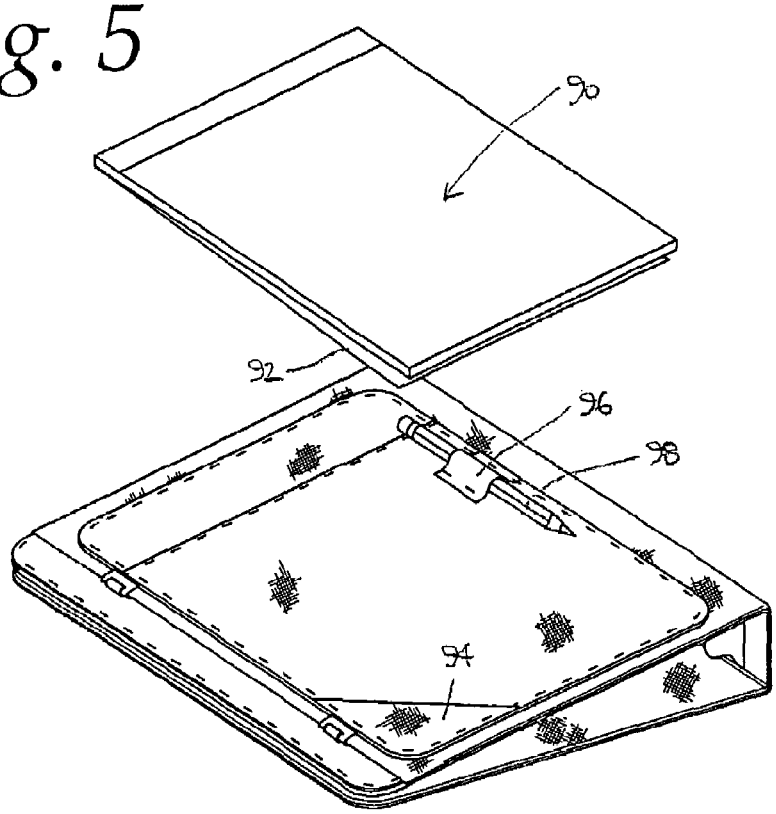
FIG. 5 is an exploded view of the notebook and paper table of FIG. 1.

As shown in FIG. 5, a holder 96 for a writing instrument 98 (such as a pen or pencil) may also be advantageously provided on the pad 40.

It should thus be appreciated that the illustrated notebook 10 may not only be advantageously used as a notebook for carrying and organizing papers in a well known manner, but that the pad 40 may be readily manipulated to move between an out-of-the-way and protected storage position and a writing position presenting a paper tablet 90 on which the user can easily write notes or the like, without requiring that the notebook 10 be opened. Thus, it should be appreciated that a user may readily take notes or the like with the notebook on their lap, or even while standing and holding the notebook 10 (as contrasted with notebooks which must be opened to access writing paper, which is an often clumsy task, particularly if a sufficiently large surface on which to place the notebook 10 is not available). Moreover, the user need not fumble through papers to find a sheet on which to write, as the pad 40 will always be readily accessible for such use. Of course, the ready accessibility of the writing instrument 98 will similarly facilitate easy of use.

It should further be appreciated that while the illustrated embodiment uses stiff cores and cloth covers to present a durable, aesthetically pleasing product, the present invention could similarly be used with notebooks and portfolios formed of different materials.

Figure 6:
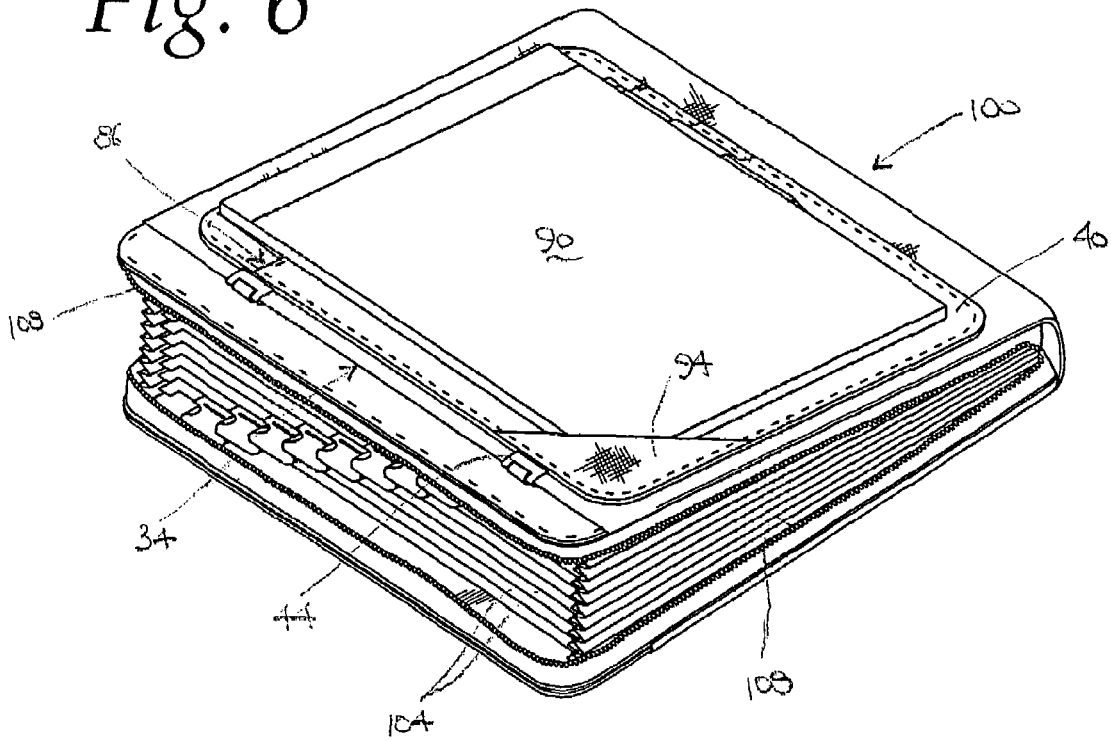
FIG. 6 is a perspective view of a portfolio embodying the present invention.

FIG. 6 illustrates another embodiment of the present invention, where a portfolio 100 has incorporated the pad 40 for supporting a paper tablet 90 and movable between a storage position and a writing position (outside the pouch 34) as previously described (in the illustration of this embodiment, similar reference numerals are used for components similar to those previously described in connection with FIGS. 1-5). The portfolio 100 includes dividers 104 defining discrete areas in which papers may be organized, and a zipper 108 may also be provided around three sides of the portfolio 100 to facilitate easy opening and closing of the portfolio 100.

Other alternates include features such as a zipper around the three open sides of a notebook, and/or a zipper for closing the open side of the pouch 34 when the pad 40 is in the storage position.

Of course, it should also be appreciated that the pad 40 and pouch 34 may be suitably sized to accommodate desired sizes of paper tablets 90. For example, to accommodate standard 8" or 8.5" wide paper tablets 90, the pouch 34 may advantageously be about 9 inches or wider. Similarly, to accommodate paper tablets 90 having loose paper lengths (i.e., the length of the paper extending beyond the bound edge) of 10.5" or 11", the pouch 34 may advantageously have a depth of about 10 inches.

It should thus be recognized that the present invention will provide a convenient device for not only storing and organizing papers and other documents, but will also provide a readily accessible and easily usable writing tablet for virtually any situation, with or without access to a surface on which to lay the device.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

The invention claimed is:

1. A portable carrier for papers, comprising:

two generally rectangular panels connected along one side and defining an interior therebetween;

a closure secured along three edges to the exterior of one of said panels to define a pouch between said one panel and said closure, said pouch having an opening along a fourth edge;

two straps extending substantially parallel to two of said secured edges of said closure, said straps each being secured in said pouch with one end at said pouch opening and the other end in said pouch adjacent the secured closure edge opposite said pouch opening;

a pad slidably connected along one side to said straps and having a storage position substantially within said pouch and a writing position outside said pouch on said closure; and a mount for securing writing paper to said pad;

wherein said pad is moved from said storage position to said writing position by sliding said pad along said straps to an intermediate position outside said pouch and then pivoting said pad about said connected side relative to said straps.

2. The paper carrier of claim 1, wherein said pad is substantially rectangular, and said connected one side of said pad includes flexible loops around said straps extending from said pad.

3. The paper carrier of claim 1, wherein one face of said pad is adjacent said one panel when said pad is in said storage position, and said mount is on said one face of said pad.

4. The paper carrier of claim 3, wherein said mount further comprises a flap on a corner of said pad one face along said pad one side adapted to cover a corner of secured writing paper.

5. The paper carrier of claim 1, wherein said pad is at least 11 inches along said fourth edge and said pouch opening is greater than the length of said pad along said fourth edge.

6. The paper carrier of claim 1, wherein said mount comprises a tablet pouch adapted to receive the back of a paper tablet.

7. The paper carrier of claim 1, further comprising a zipper along said closure fourth edge for selectively closing said pouch opening when said pad is in said storage position.

8. The paper carrier of claim 1, wherein said connected one side of said two panels is hinged.

9. The paper carrier of claim 8, wherein said container is a portfolio having a zipper closure between the other three sides of the rectangular panels.

10. The paper carrier of claim 8, wherein said container is a ring notebook.

11. The paper carrier of claim 1, further comprising a holder for a writing instrument on said pad.

12. A personal carrier for papers, comprising:

two generally rectangular panels hinged together along one side and defining an interior there between;

a closure secured along three edges to the exterior of one of said panels to define a pouch between said one panel and said closure, said pouch having an opening along a fourth edge;

two straps extending substantially parallel to two of said secured edges of said closure, said straps each being secured in said pouch with one end at said pouch opening and the other end in said pouch adjacent the secured closure edge opposite said pouch opening;

a pad having flexible loops on one side slidably connected to said straps; and a tablet pouch on said pad adapted to receive the back of a paper tablet to secure said paper tablet thereon; wherein said pad is moved from a storage position substantially within said pouch to a writing position outside the pouch and on said closure by sliding said pad along said straps to an intermediate position outside said pouch and then pivoting said pad about said connected side relative to said straps, and one face of said pad is adjacent said one panel when said pad is in said storage position, and said tablet pouch is on said one face of said pad.

13. The paper carrier of claim 12, further comprising a flap on a corner of said pad one face along said pad one side adapted to cover a corner of secured writing paper.

14. The paper carrier of claim 12, wherein said pad is at least 11 inches along said fourth edge and said pouch opening is greater than the length of said pad along said fourth edge.

15. The paper carrier of claim 12, further comprising a zipper along said closure fourth edge for selectively closing said pouch opening when said pad is in said storage position.

16. The paper carrier of claim 12, wherein said container is a portfolio having a zipper closure between the other three sides of the rectangular panels.

17. The paper carrier of claim 12, wherein said container is a ring notebook.

18. The paper carrier of claim 12, further comprising a holder for a writing instrument on said pad.

* * * * *